US008528292B2

(12) United States Patent
Morey

(10) Patent No.: US 8,528,292 B2
(45) Date of Patent: Sep. 10, 2013

(54) SUPPORT FRAMING SYSTEM FOR USE WITH BAR JOISTS AND BEAMS

(75) Inventor: Douglas H. Morey, Claredon Hills, IL (US)

(73) Assignee: Douglas H. Morey, Broadview, IL (US)

( * ) Notice: Subject to any disclaimer, the term of this patent is extended or adjusted under 35 U.S.C. 154(b) by 188 days.

(21) Appl. No.: 13/143,828

(22) PCT Filed: Jan. 15, 2010

(86) PCT No.: PCT/US2010/021210

§ 371 (c)(1), (2), (4) Date: Aug. 9, 2011

(87) PCT Pub. No.: WO2010/083423

PCT Pub. Date: Jul. 22, 2010

(65) Prior Publication Data

US 2011/0289878 A1 Dec. 1, 2011

Related U.S. Application Data

(60) Provisional application No. 61/144,950, filed on Jan. 15, 2009.

(51) Int. Cl.
*E04C 2/52* (2006.01)

(52) U.S. Cl.
USPC ..... 52/655.1; 52/650.3; 52/646; 52/220.8

(58) Field of Classification Search
USPC ..... 52/650.3, 220.8, 646, 289, 654.1, 52/653.1, 655.1, 39, 696, 27, 712; 248/200, 248/205.1, 500, 505; 403/169–178, 218, 403/384, 396, 400, 385, 403, 187, 205
See application file for complete search history.

(56) References Cited

U.S. PATENT DOCUMENTS

| | | | | | |
|---|---|---|---|---|---|
| 1,734,407 | A | * | 11/1929 | Taussig | 403/205 |
| 2,926,941 | A | * | 3/1960 | Thompson | 403/173 |
| 2,931,129 | A | * | 4/1960 | Boniface | 446/126 |
| 3,256,030 | A | * | 6/1966 | Banse | 403/400 |
| 3,462,021 | A | * | 8/1969 | Hawke et al. | 211/182 |
| 4,600,232 | A | | 7/1986 | Phillips | |
| 4,885,883 | A | * | 12/1989 | Wright | 52/280 |
| 4,982,548 | A | | 1/1991 | Abbey | |

(Continued)

OTHER PUBLICATIONS

International Search Report and Written Opinion for corresponding International Application No. PCT/US2010/021210, dated Mar. 22, 2010.

*Primary Examiner* — Robert Canfield
*Assistant Examiner* — Babajide Demuren
(74) *Attorney, Agent, or Firm* — Marshall, Gerstein & Borun LLP

(57) ABSTRACT

A support system securable between pairs of metal bar joists or beams includes one or more end brackets secured to the top of a first bar joist at one end, and another corresponding number of end brackets secured to the top of a second bar joist opposite the first two end brackets. One or more elongate bars span the distance separating the bar joists. Each elongate bar is secured to one of the end brackets secured to the first bar joist at a first end, and to the respective, aligned end bracket secured to the second bar joist at a second end. Cross members, each defined by a pair T-shaped bracket assemblies having cross bars secured thereto, are secured between the elongate bars.

16 Claims, 19 Drawing Sheets

(56) References Cited

U.S. PATENT DOCUMENTS 5,349,800 A * 9/1994 Peng ..... 52/506.06
5,403,110 A * 4/1995 Sammann ..... 403/234
5,647,175 A * 7/1997 Smyth ..... 52/58
5,803,653 A 9/1998 Zuffetti
6,729,083 B1 * 5/2004 Soyko ..... 52/220.8
7,398,621 B2 7/2008 Banta
2007/0266674 A1 11/2007 Morey

* cited by examiner 10
28
62'
76
14
112
74
26
16
28
26
28
16
76
112
74
14
62
76
28

SUPPORT FRAMING SYSTEM FOR USE WITH BAR JOISTS AND BEAMS

REFERENCE TO RELATED APPLICATIONS

This application is the US national phase of international application no. PCT/US2010/02120, filed Jan. 15, 2010, which is entitiled to the benefit of the filing date of United States Provisional Application No. 61/144,950, filed Jan. 15, 2009, as to all subject matter disclosed therein. The entire disclosure of U.S. Provisional Application No. 61/144,950 is incorporated herein by reference.

FIELD OF THE DISCLOSURE

This disclosure relates to a clamp for use with metal bar joists and beams in order to secure cross members to roof joists.

BACKGROUND OF THE DISCLOSURE

In building construction, and in steel-framed building construction in particular, metal bar joists and wide flange beam joists are used as roof framing, typically under corrugated roof decking. The metal bar joists or beams are also used to hang such items as lighting fixtures, sprinkler header assemblies, product conveyors, skylights, HVAC equipment, drywall for ceilings, and the like. For large equipment components, such as some air conditioning units, it is necessary to cut through sections of the corrugated roof decking to form an opening sized to receive the large equipment. Openings are also formed by cutting through sections of roof decking for other purposes, such as to create roof access openings.

In order to reinforce the weakened roof decking above the joist structure once such openings are formed, the typical practice is to weld angle clips to bar joists at panel points to support welded angle framing steel. Panel points are locations just above the apex of a structural bar element that depends downwardly, at an angle, from the upper pair of angle irons of metal bar joists. These zigzagging diagonal bar elements form a truss support structure.

Equipment may be set on a roof deck having greater weight than the decking can support, but within the capacity of the roof joist structure. There is a need to reliably transfer such loads from the decking to the bar joists or beams.

The conventional practice of welding clips to support welded angle framing steel has several drawbacks. For instance, the welding may cause unintended structural damage to the remaining length of the joists through undercutting; the welding may have to be performed from awkward angles, with limited space constraints, making the welding difficult or dangerous; and the welding must be performed by skilled certified welders.

Another common way to install pieces of framing angle between joists is to cut out a section from each end of a 90°-shaped piece of metal, so that one flat surface remains on each end. This flat surface then rests on top of each parallel running joist, with the cut surface extending downward, to be used for mounting equipment. However, such a support angle would need to be installed before the decking. There can also be other problems associated with this arrangement. For example, any time material is removed from a structural component, such as a framing angle, it will then become weakened and will be less capable of supporting loads. Also, stress will tend to be concentrated along the line where the edge of the top flange of the joist meets the non-cut side of the framing angle. As a direct result of this non-uniform, poorly-distributed load, the top flange of the joist can end up bending, and this can lead to roof failure.

As demonstrated in the following sections, a support system is disclosed that can be secured in place at strategic locations along joists, under the corrugated roof decking, as a more reliable solution to reinforcing roofing structure in the vicinity of openings formed in roof decking. The solution is also useful to transfer loads to bar joists or beams in roofing structures where no openings are formed. For example, the support system of the present disclosure may be employed where structural reinforcement is necessary in order to support loads above or below particular locations in the roof, such as for heavy air conditioning condenser units, lighting fixtures, ceiling fans, article conveyors, or the like.

SUMMARY OF THE DISCLOSURE

A support system that is securable between pairs of metal bar joists or beams is disclosed. The support system includes one or more end brackets that are secured to the top of a first bar joist or wide flange beam at one end, and the same number of end brackets that are secured to the top of a second bar joist or beam at an opposite end. While the embodiments disclosed herein are predominantly described below as being applied to bar joists, those of ordinary skill in the art will understand that the present support system may alternately be applied to wide flange beams in a similar manner. Each of the end brackets secured to the top of the first bar joist is aligned with a respective one of the end brackets secured to the second bar joist. The support system further includes at least one elongate bar, preferably comprising tube steel, spanning the distance separating the first and second bar joists. Each of the elongate bars is secured to one of the end brackets secured to the first bar joist at a first end, and to the respective, aligned end bracket secured to the second bar joist at a second end.

In one embodiment, each of the end brackets includes a channel member that extends over the bar joist to which the end bracket is secured, and a saddle attached to the channel member, the saddle having a top plate and two sidewalls extending downwardly from the top plate. In another embodiment, as an alternative to a channel member, each of the end brackets includes a tube member that extends over the bar joist or wide flange beam to which the end bracket is secured. In this alternate embodiment, a saddle attaches to the tube member, the saddle having a top plate and two side walls extending downwardly from the top plate. By way of example only, the saddle may be attached to the channel member or tube member by rivets, spot welds or plug welds. Apart from the substitution of a tube member for a channel member, the remaining details of these alternate end brackets, and their manner of application in the support system of the present disclosure, are the same as the end brackets of the first embodiment, and for the sake of brevity, such details are not repeated herein. The sidewalls of the saddle straddle the sides of the elongate bar formed of tube steel, and extend below the sides of the elongate bar. The sidewalls of the saddle are provided with opposing fastener-receiving apertures spaced vertically below the bottom of the channel member a distance greater than the height of the sides of the elongate bar. The fastener-receiving apertures on at least one of the sidewalls are preferably square to accommodate a complementary underside of a head of a carriage bolt, thereby preventing rotation of the carriage bolt relative to the saddle.

The support system may further include one or more cross members secured to the elongate bars. Each of the cross members includes a pair of generally T-shaped bracket assemblies, each of which is referred to herein as "T-bracket assembly," one at either end thereof. Each T-bracket assembly includes a first T-bracket saddle portion (forming the upper cross-portion of the "T" shape) that extends over and straddles one of the elongate bars in a similar fashion to the saddle of the end brackets. Opposing fastener-receiving apertures are provided on sidewalls of the first T-bracket saddle portion, with the fastener-receiving apertures spaced vertically below a top plate of the first T-bracket saddle portion a distance greater than the height of the sides of the elongate bar.

Each T-bracket assembly further includes a second T-bracket saddle portion (forming the trunk portion of the "T" shape), extending perpendicularly from a central region of one of the sidewalls of the first T-bracket saddle portion. The second T-bracket saddle portion has a top wall which may include a cut out section to accommodate a rib of a roof deck, and a pair of downwardly-depending sidewalls having opposing fastener-receiving apertures provided therein. At least one of the sidewalls of the second T-bracket saddle portion of the T-bracket assembly may be provided with a retaining tang that may be bent inwardly, toward the opposing sidewall, to aid in the installation of a cross bar, which may be formed of tube steel, into the second T-bracket saddle portion.

Opposing fastener-receiving apertures are provided on sidewalls of the second T-bracket saddle portion, with the fastener-receiving apertures spaced vertically below the top wall of the second T-bracket saddle portion a distance greater than the height of the sides of the cross bar. As in the case of the saddle of the end bracket, at least one of each opposing pair of fastener-receiving apertures of the first and second T-bracket saddle portion is preferably square to accommodate a complementary underside of a head of a carriage bolt, thereby preventing rotation of the carriage bolt relative to the respective sidewall.

A cross member is thus defined by the cross bar and the T-bracket assemblies to which the cross bar is secured at either end. With a pair of such cross members secured between the elongate bars, and the elongate bars secured via the end brackets to the bar joists, the support system is able to accommodate and transmit loads. Installation of the support system of the present disclosure requires no welding of its various components to the bar joists. The support structure will now be described in more detail in the following description of the drawings and the Detailed Description of the Preferred Embodiments.

DETAILED DESCRIPTION OF THE PREFERRED EMBODIMENTS

Figure 2:
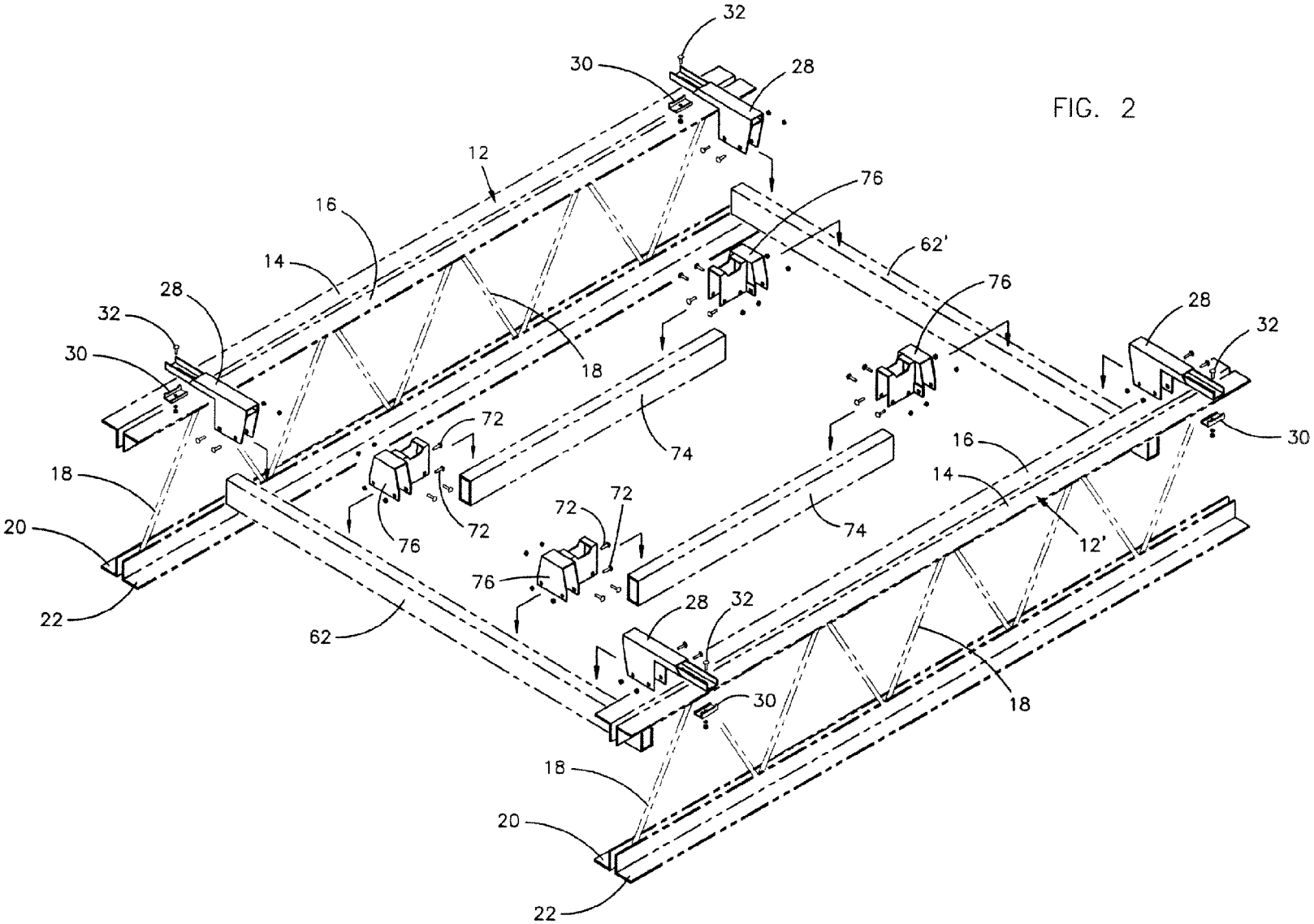
FIG. 2 is an exploded view of the support system of FIG. 1.
Figure 3:
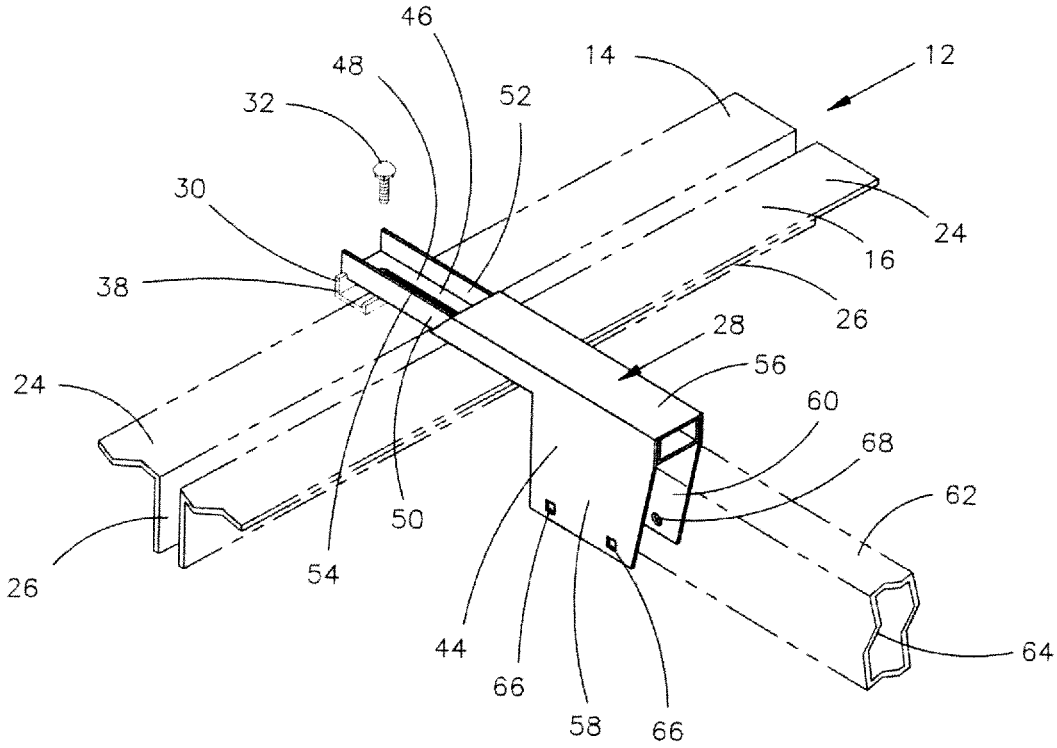
FIG. 3 is a perspective view of an end bracket of the support system of FIG. 1, secured to the top of a bar joist.
Figure 4:
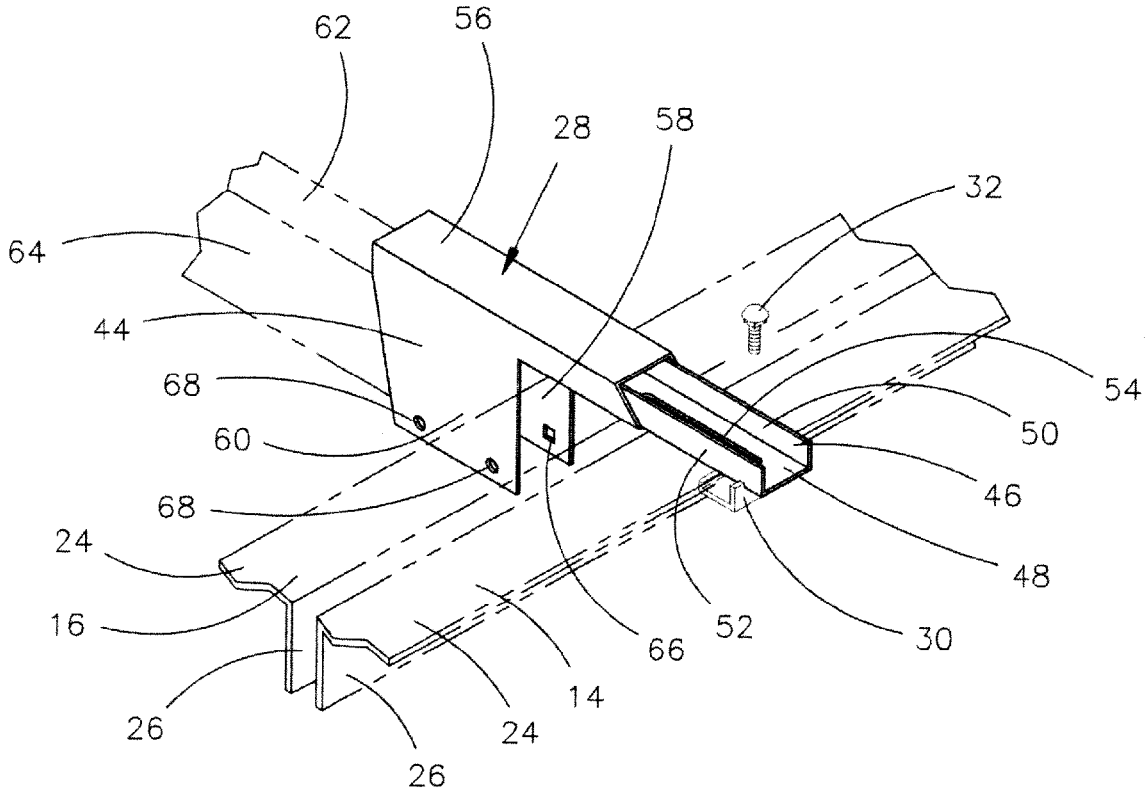
FIG. 4 is another perspective view of an end bracket of the support system of FIG. 1 secured to the top of a bar joist.

The support system 10 of the present disclosure is useful for supporting loads at locations between wide flange beams or bar joists 12, 12' while transferring forces and loads to the bar joists 12, 12'. As is known in the art, a bar joist is a structural member typically used to support a roof structure, commonly a corrugated roof. As best shown in FIG. 2, a bar joist 12, 12' includes an upper pair of angle irons 14, 16 spaced apart from one another by the thickness of an intermediate truss arrangement of bar elements 18, and a lower pair of angle irons 20, 22, also spaced apart from one another by the thickness of the intermediate truss arrangement of bar elements 18. Each of the upper angle irons 14, 16 is oriented with its horizontal flange 24 oriented at the top of the bar joist 12, 12', and with its vertical flange 26 extending downwardly from an edge closest to the opposing upper angle iron 16, 14. Each of the lower angle irons 20, 22 is oriented with its horizontal flange 24 oriented at the bottom of the bar joist 12, 12', and with its vertical flange 26 extending upwardly from an edge closest to the opposing lower angle iron 22, 20.

Figure 5:
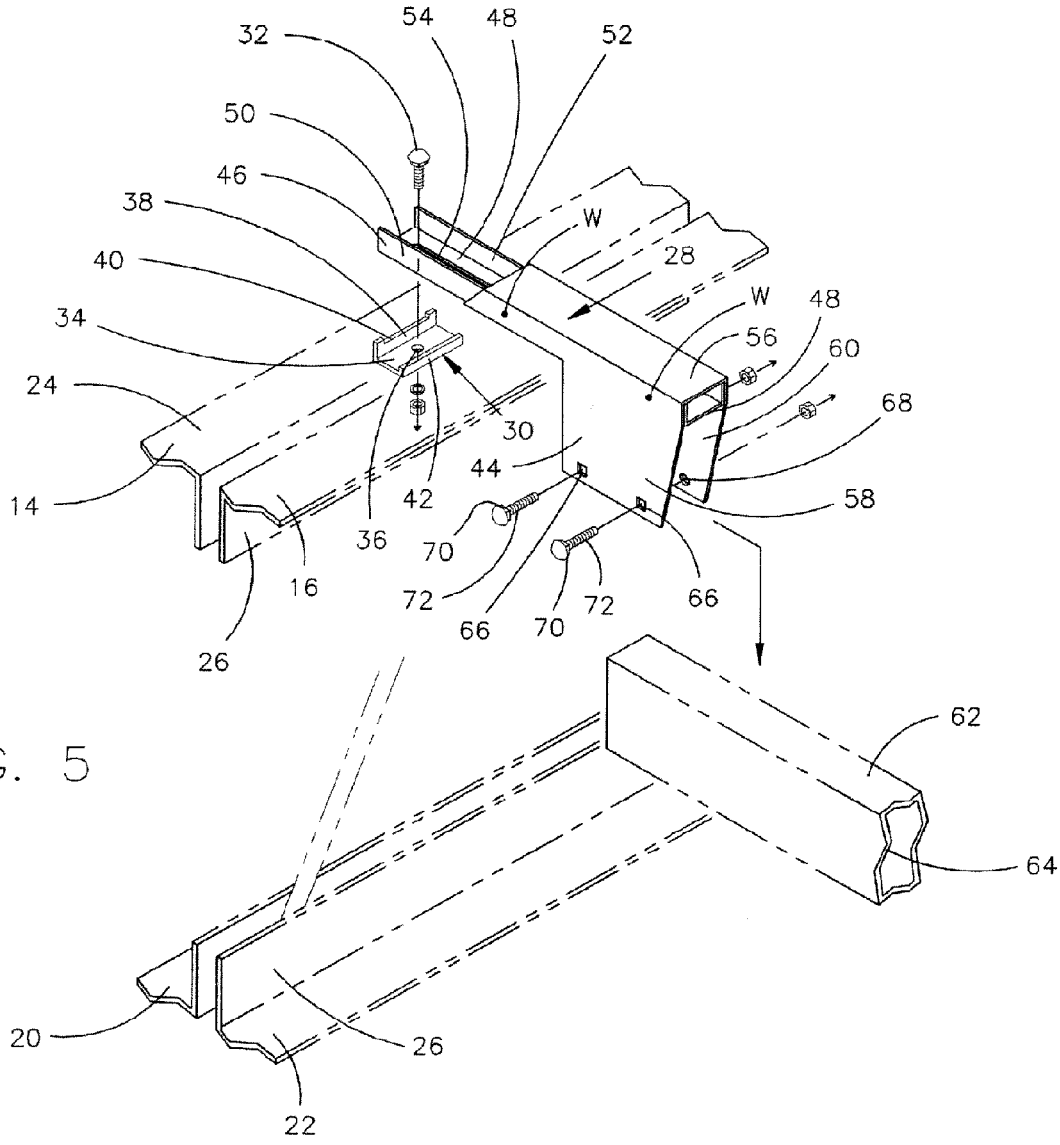
FIG. 5 is an exploded perspective view of an end bracket of the support system of FIG. 1, with a bar joist and elongate bar illustrated in phantom lines.
Figure 6:
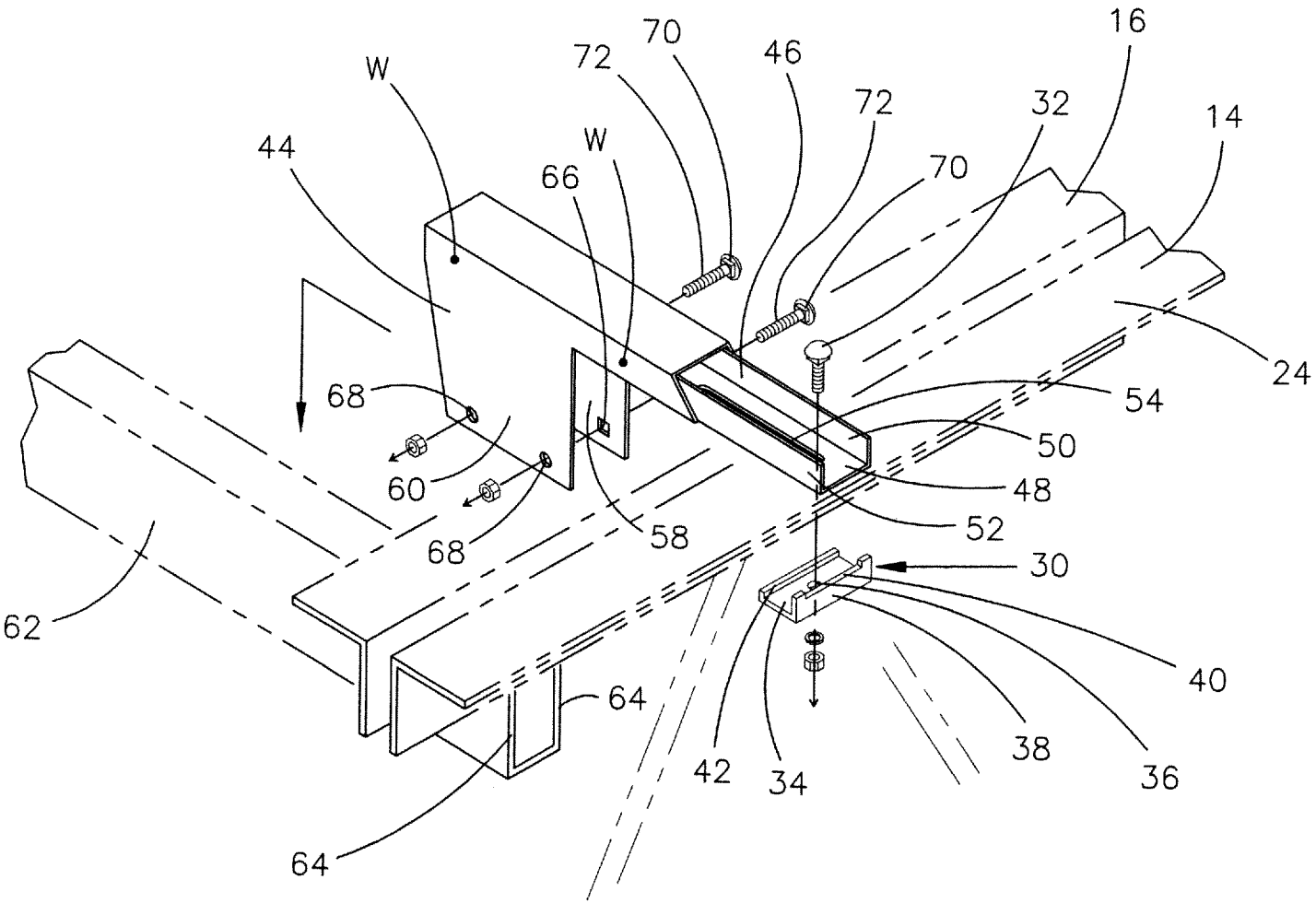
FIG. 6 is another exploded perspective view of an end bracket of the support system of FIG. 1, with a bar joist and elongate bar illustrated in phantom lines.
Figure 6A:
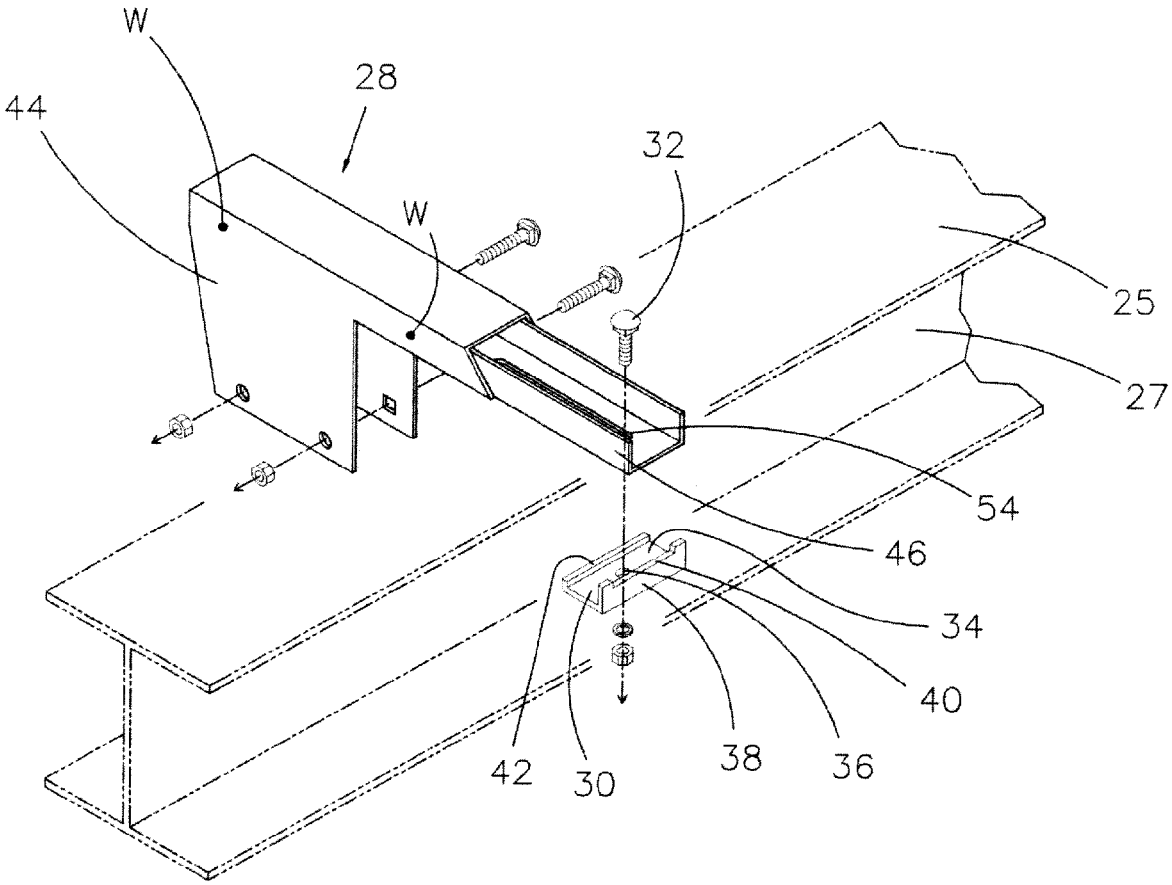
FIG. 6*a* is an exploded perspective view of an end bracket of the support system of present disclosure, with a wide flange beam illustrated in phantom lines.
Figure 7:
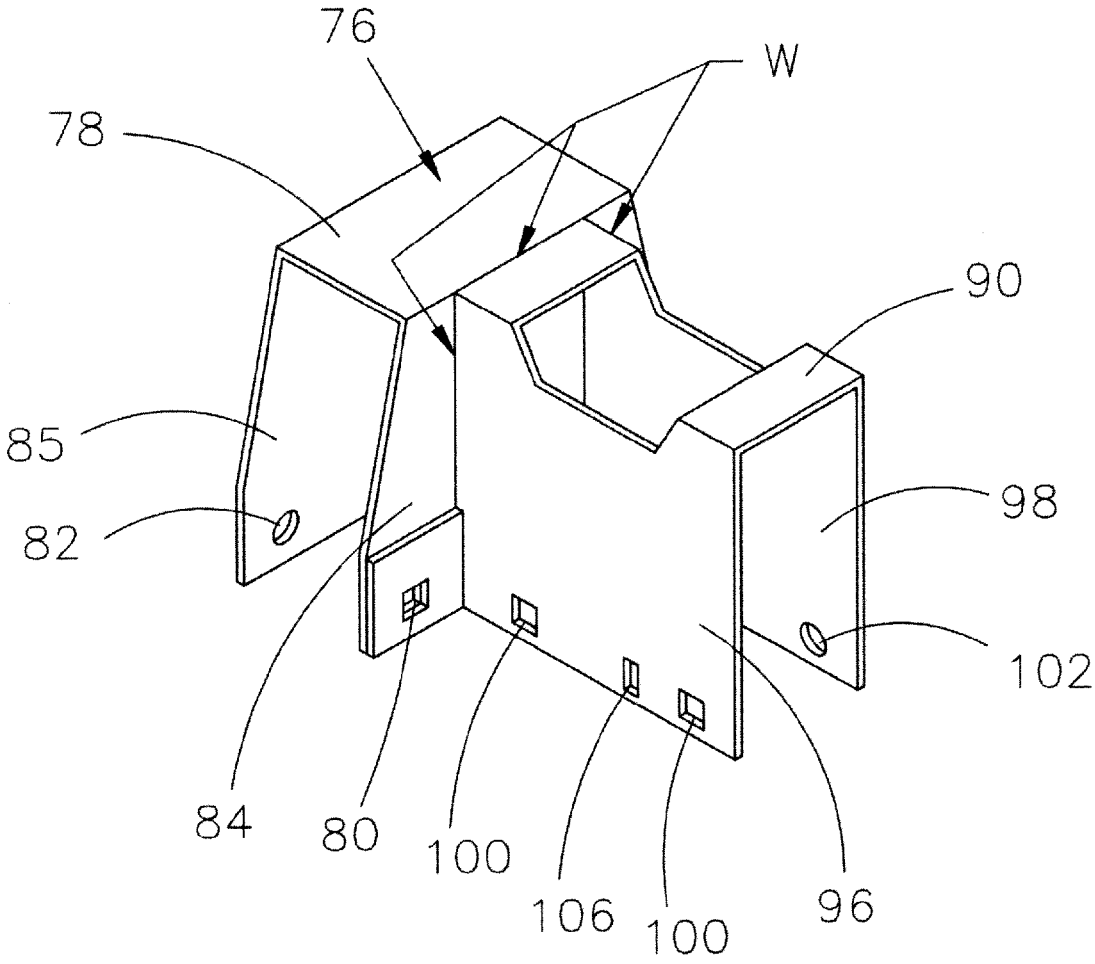
FIG. 7 is a perspective view of a T-bracket assembly of the support system of FIG. 1.
Figure 8:
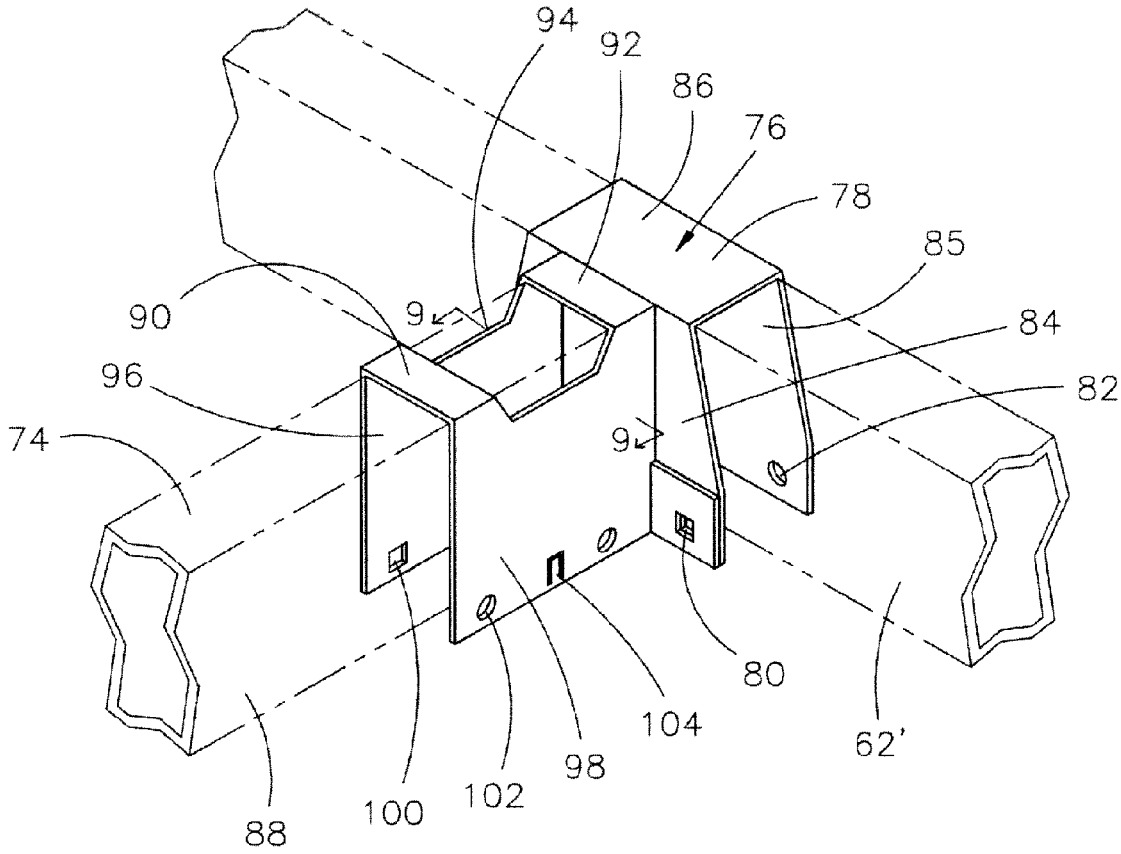
FIG. 8 is another perspective view of the T-bracket assembly of the support system of FIG. 1, with an elongate bar and a cross bar illustrated in phantom lines.
Figure 9:
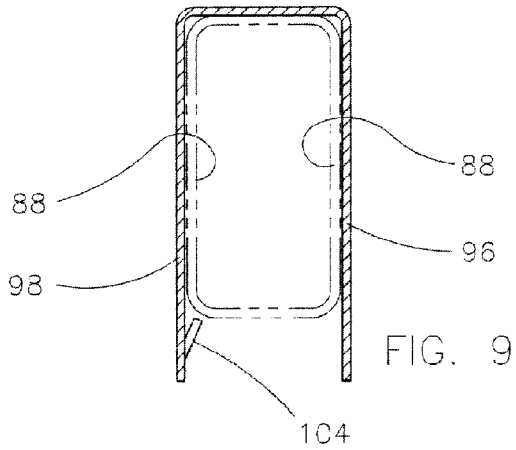
FIG. 9 is a cross-sectional view of the T-bracket assembly of FIG. 8, taken along lines 9-9 of FIG. 8.
Figure 10:
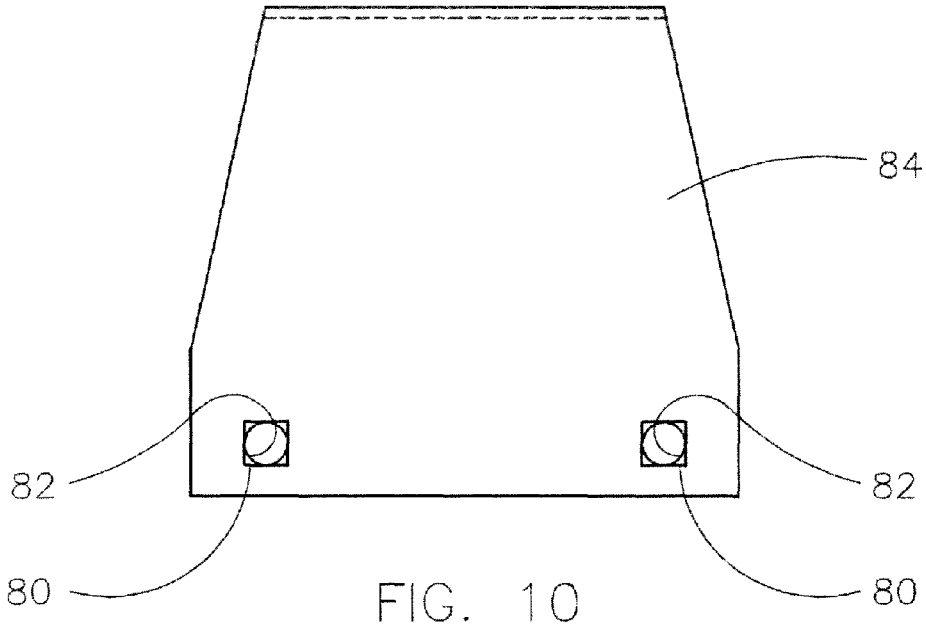
FIG. 10 is a plan view of the first T-bracket saddle portion of the T-bracket assembly of FIG. 8, illustrating a sidewall of the first T-bracket saddle portion to which the second T-bracket saddle portion is attached.
Figure 11:
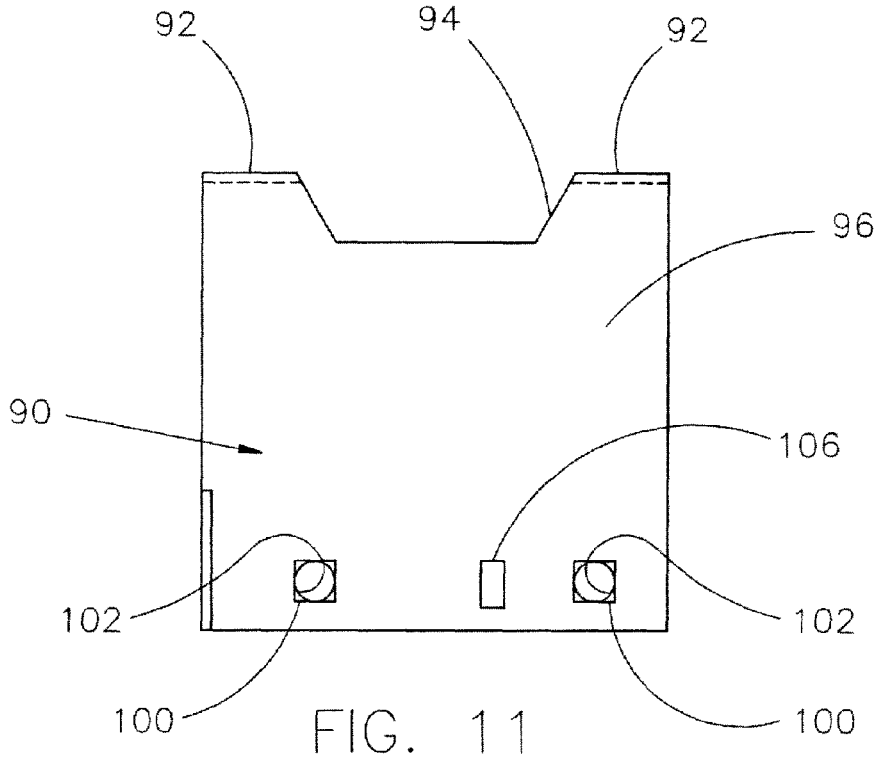
FIG. 11 is a plan view of the second T-bracket saddle portion of the T-bracket assembly of FIG. 8, illustrating a sidewall of the second T-bracket assembly that extends perpendicularly to the sidewall of the first T-bracket saddle portion of FIG. 10.
Figure 12:
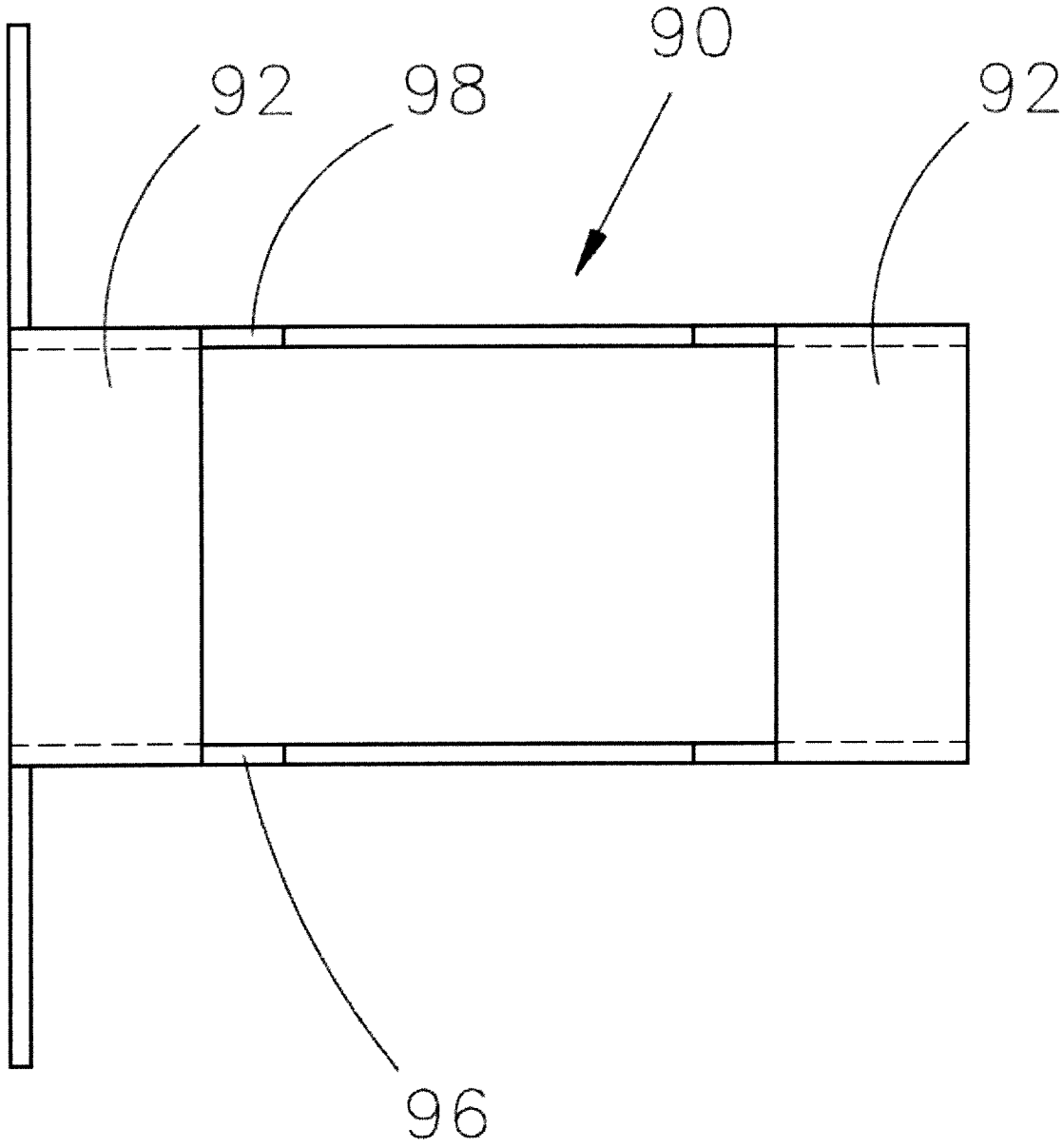
FIG. 12 is a top view of the second T-bracket saddle portion of the T-bracket assembly of FIG. 8.
Figure 13:
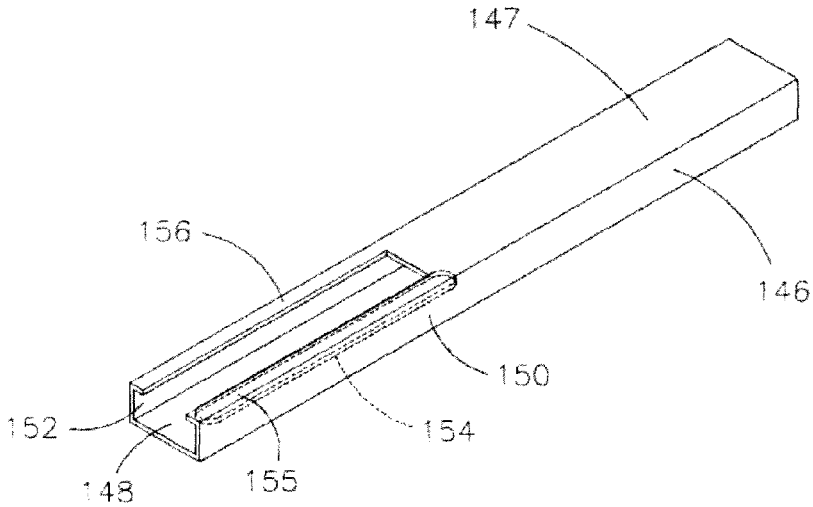
FIG. 13 is a perspective view of a tube member for use in an alternate end bracket of the support system of the present disclosure.
Figure 14:
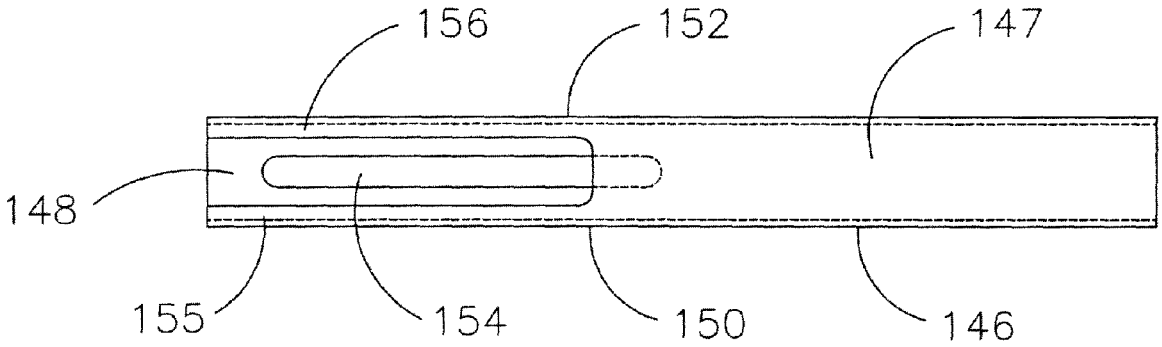
FIG. 14 is a top plan view of the tube member of FIG. 13.
Figure 17A:
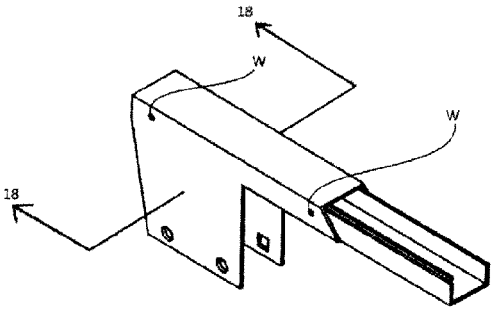
FIGS. 17*a* and 17*b* are perspective views of an end bracket provided with a channel member, wherein the saddle and the channel member of the end clamp are welded to one another.
Figure 15A:
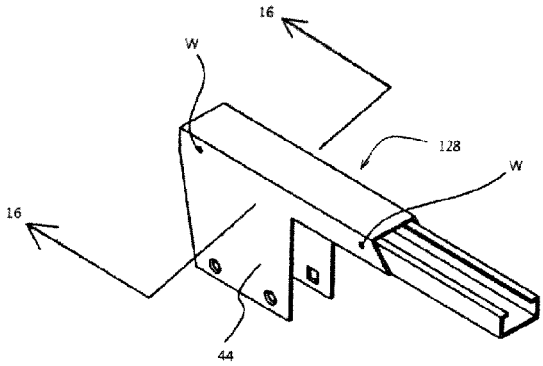
FIGS. 15*a* and 15*b* are perspective views of an end bracket provided with the tube member of FIG. 13, wherein the saddle and the tube member of the end clamp are welded to one another.
Figure 17B:
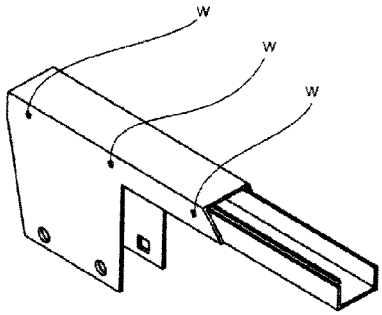
Figure 15B:
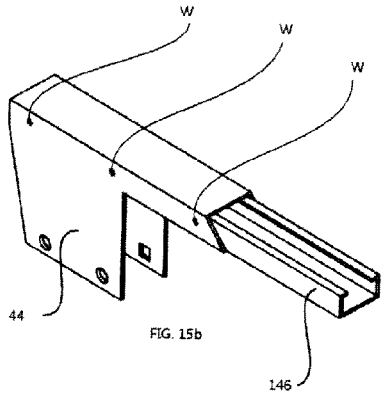
Figure 17C:
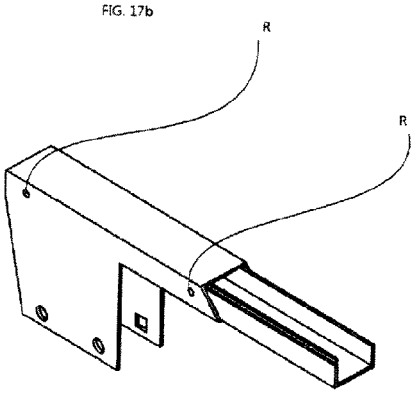
FIGS. 17*c* and 17*d* are perspective views of an end bracket provided with a channel member, wherein the saddle and the channel member of the end clamp are riveted to one another.
Figure 15C:
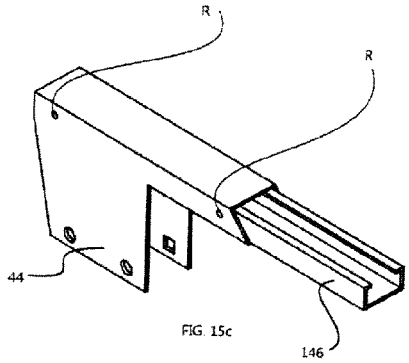
FIGS. 15*c* and 15*d* are perspective views of an end bracket provided with the tube member of FIG. 13, wherein the saddle and the tube member of the end clamp are riveted to one another.
Figure 17D:
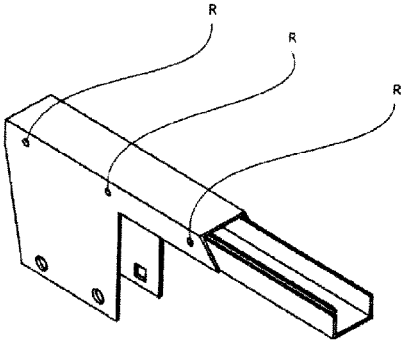
Figure 15D:
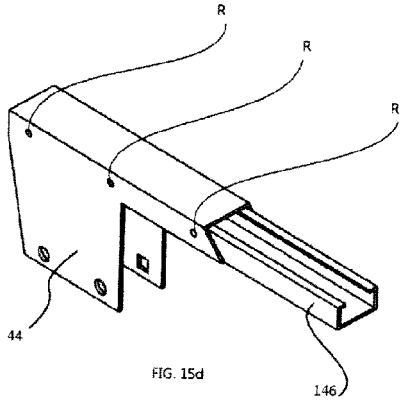
Figure 16:
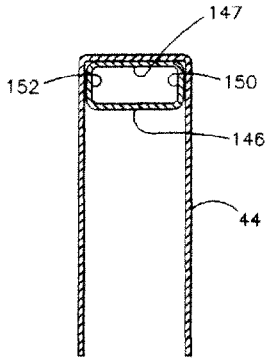
FIG. 16 is a cross-sectional view taken along lines 16-16 of FIG. 15*a;*
Figure 18:
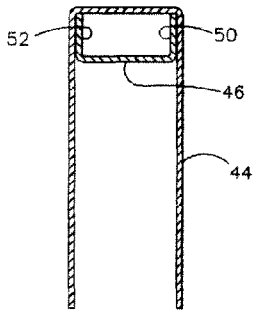
FIG. 18 is a cross-sectional view taken along lines 18-18 of FIG. 17*a;*
Figure 22:
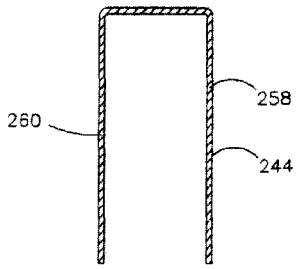
FIG. 22 is a cross-sectional view of the end bracket of FIG. 21, taken along lines 22-22 of FIG. 21.
Figure 19:
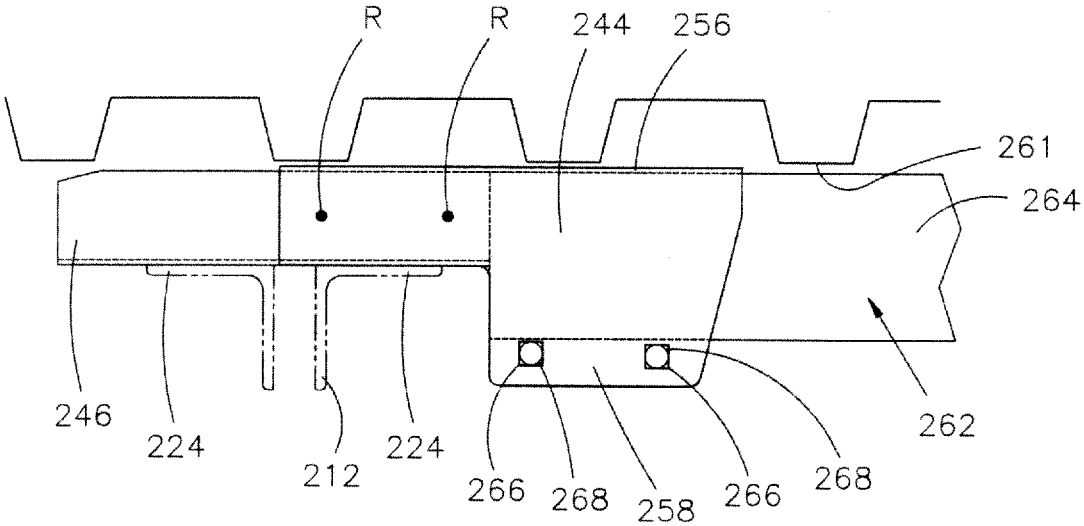
FIG. 19 is a plan view of yet another alternate embodiment of the support system of the present disclosure, adapted for use with joist girders.
Figure 20:
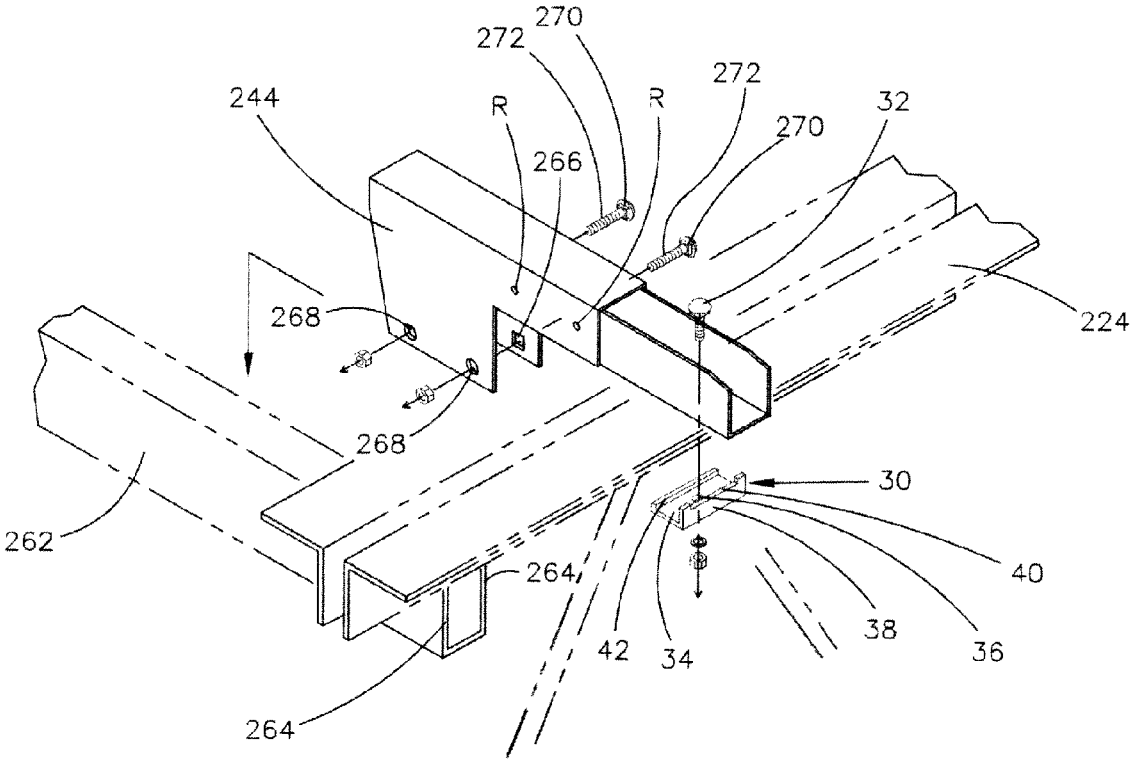
FIG. 20 is an exploded perspective view of the support system embodiment of FIG. 19.
Figure 21:
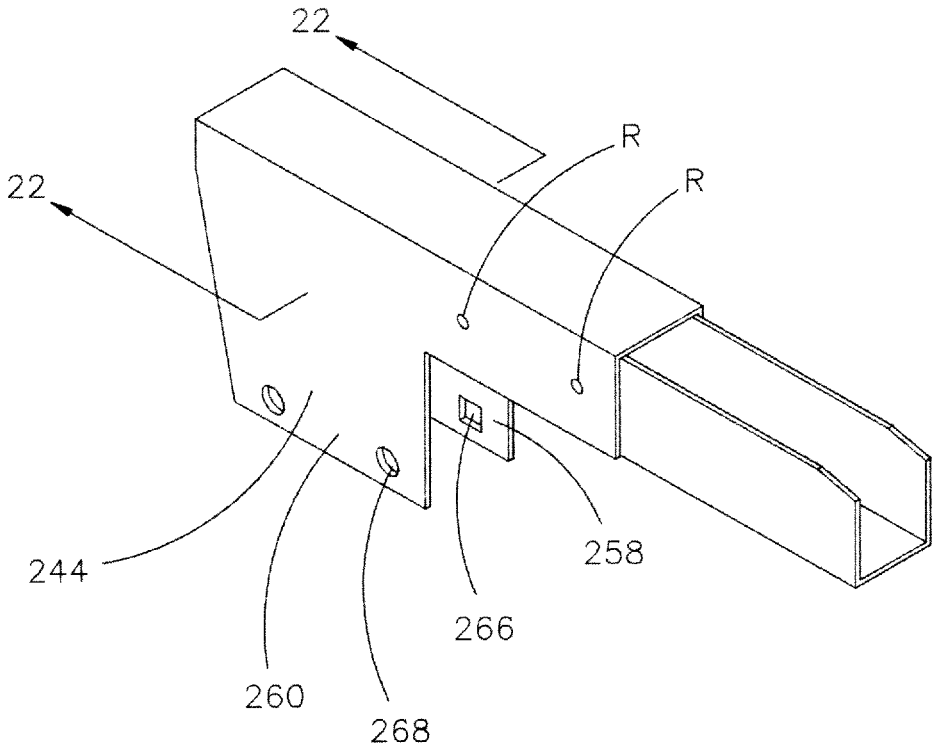
FIG. 21 is a perspective view of an end bracket of the support system illustrated in FIG. 19.

The support system 10 includes four end brackets 28. Each of the end brackets 28 is securable to the upper pair of angle irons 14, 16 of one of the bar joists 12, 12'. As an alternative to a bar joist, the end brackets 28 may be secured to the upper horizontal flange 25 of a wide flange beam 27, as illustrated in FIG. 6*a*. A heel clip 30 (as best illustrated in FIGS. 5 and 6) and a fastener, such as a bolt 32, together with a nut and/or a washer, are used to secure each end bracket 28 to the horizontal flange 24 of one of the upper angle irons 14, 16, or to the upper horizontal flange 25 of the wide flange beam 27. In each instance of the present disclosure in which a fastener, such as a bolt or a carriage bolt, is disclosed, it is understood that the securement at the given location may include a bolt and/or nut, even if not specifically described. The support system 10 of the present disclosure preferably employs grade 5 carriage bolts. However, lower grade carriage bolts may be satisfactory for the bolts 32 of the end brackets 28. The heel clip 30 has a bottom plate 34 with an aperture 36 therethrough, and an end wall 38 having an upwardly-open slot 40 therein. The heel clip 30 may have another end wall or lip 42 opposite the end wall 38.

In a first embodiment, the end bracket 28 includes a saddle 44 and a channel member 46. The channel member 46 may be riveted, spot welded, or plug welded to an interior of the saddle 44, such as at locations R (rivet) or W (weld) indicated in FIGS. 5, 6, 6*a*, and 17*a*-17*d*. The channel member 46 includes a bottom wall 48, and two upwardly-extending sidewalls 50, 52. An aperture, preferably in the form of an elongate slot 54, is provided in the bottom wall 48. The saddle 44 includes a top plate 56 and two sidewalls 58, 60 extending downwardly from the top plate. When the end bracket 28 is secured to a bar joist 12 or 12', the sidewalls 58, 60 project inwardly from the bar joist 12, 12', i.e. closer the other bar joist 12' or 12, and the channel member 46 extends outwardly of the bar joist 12, 12'. The saddle 44 and channel member 46 cooperate with one another to act as a tube member. In an end bracket 128 of an alternate embodiment, instead of the channel member 46, a tube member 146 formed from a length of tube steel may be provided in the saddle 44, as shown in FIGS. 13-16. The tube member 146 may have a segment of its upper wall 147 removed and have an aperture, preferably in the form of an elongate slot 154, formed in the bottom wall 148 thereof to receive a fastener. The tube member 146 includes side walls 150, 152. The tube member 146 may include elongate opposing, inwardly-directed flanges 155, 156 at the upper edges of the side walls 150, 152, formed by removing less than the total width of the upper wall 147 when removing the segment of the upper wall 147. The tube member 146 may be riveted, spot welded, or plug welded to an interior of the saddle 44, such as at locations R (rivet) or W (weld) indicated in FIGS. 15*a*-15*d*, in the same manner as the channel member 46 of the end bracket 28.

The sidewalls 58, 60 of the saddle 44 straddle the sides of an elongate bar 62, which may be formed of tube steel. The sidewalls 58, 60 of the saddle 44 extend below the sidewalls 64 of the elongate bar 62. Opposing fastener-receiving apertures 66, 68 are provided in the sidewalls 58, 60 of the saddle 44. The opposing fastener-receiving apertures 66, 68 are spaced vertically below the bottom wall 48 of the channel member 46 a distance greater than the height of the sidewalls 64 of the elongate bar 62. The fastener-receiving apertures 66 on at least one of the sidewalls 58, 60 of the saddle 44 are preferably square to accommodate a complementary square underside 70 of a head of a carriage bolt 72, thereby preventing rotation of the carriage bolt 72 relative to the saddle 44.

Figure 1:
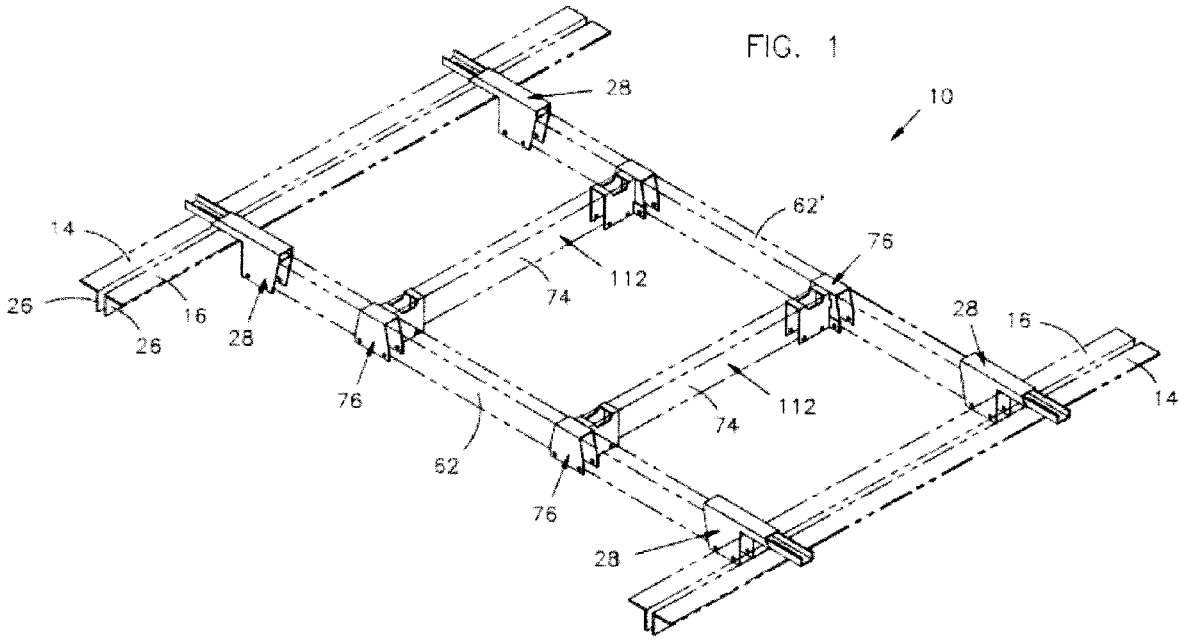
FIG. 1 is an elevated perspective view of the support system of the present disclosure, installed between a pair of bar joists.

The elongate bar 62 is secured to the saddle 44 of each of two of the end brackets 28, one at either end of the elongate bar 62, and one of the end brackets 28 is secured to each of the bar joists 12, 12', as illustrated in FIGS. 1 and 2. A second elongate bar 62' is secured to the saddle 44 of each of two additional end brackets 28, one at either end of the second elongate bar 62', with one of the additional end brackets 28 secured to each of the bar joists 12, 12'. The end brackets 28 are spaced from one another along each of the bar joists 12, 12' to provide desired spacing of the second elongate bar 62' from the first elongate bar 62.

In order to secure a pair of cross bars 74, which may also be formed of tube steel, between the first elongate bar 62 and second elongate bar 62', two T-bracket assemblies 76 are secured to each of the elongate bars 62, 62'. As best illustrated in FIGS. 7-12, each T-bracket assembly 76 includes a first T-bracket saddle portion 78 (forming the upper cross-portion of the "T" shape) that extends over and straddles one of the elongate bars 62, 62' in a similar fashion to the saddle 44 of the end brackets 28. Opposing fastener-receiving apertures 80, 82 are provided on sidewalls 84, 85 of the first T-bracket saddle portion 78. The fastener-receiving apertures 80, 82 are spaced vertically below a top plate 86 of the first T-bracket saddle portion a distance greater than the height of the sidewalls 64 of the elongate bar 62, 62'. The fastener-receiving apertures 80 on at least one of the sidewalls 84 of the first T-bracket saddle portion 78 are preferably square to accommodate a complementary square underside 70 of a head of a carriage bolt 72, thereby preventing rotation of the carriage bolt 72 relative to the first T-bracket saddle portion 78.

Each T-bracket assembly 76 further includes a second T-bracket saddle portion 90 (forming the trunk portion of the "T" shape), extending perpendicularly from a central region of one of the sidewalls 84 of the first T-bracket saddle portion 78. The second T-bracket saddle portion 90 has a top wall 92. The top wall 92 may include a cut out section 94 to accommodate a rib of a roof deck (not shown). The cut out section 94 allows for roof weight to be placed directly onto the cross bar 74. It also keeps the cross bar 74 flush with the normal elevation of the roof instead of forcing the rooftop up the thickness of the top wall 92. The second T-bracket saddle portion 90 also includes a pair of sidewalls 96, 98 depending downwardly from the top wall 92. The sidewalls 96, 98 have opposing fastener-receiving apertures 100, 102 provided therein.

The fastener-receiving apertures 100, 102 are spaced vertically below the top wall 92 of the second T-bracket saddle portion 90 a distance greater than the height of the sidewalls 88 of the cross bar 74. As in the case of the saddle 44 of the end bracket 28 and the first T-bracket saddle portion 78, at least one of each opposing pair of fastener-receiving apertures 100, 102 of the second T-bracket saddle portion 90 is preferably square to accommodate a complementary underside 70 of a head of a carriage bolt 72, thereby preventing rotation of the carriage bolt 72 relative to the respective sidewall 96.

A retaining tang 104 (see FIG. 8) is preferably provided in at least one of the sidewalls of the second T-bracket saddle portion 90 of the T-bracket assembly 76. The retaining tang 104 may be deployed, i.e. bent inwardly, toward the opposing sidewall, thereby helping to secure the cross bar 74 during installation, and not to support any significant loads, until fasteners, such as carriage bolts 72, are inserted into the opposing fastener-receiving apertures 100, 102 and secured in place, such as with hex nuts and washers. The tang may be bent more inwardly or less inwardly by the user as desired.

In order to attach the second T-bracket saddle portion 90 to the first T-bracket saddle portion 78, bolts can be inserted through the common fastener-receiving apertures 80, 82. Additionally, the second T-bracket saddle portion 90 may be riveted, spot welded, or plug welded to the first T-bracket saddle portion 78, such as at locations W indicated by the arrows in FIG. 7.

One of the sidewalls 96 of the second T-bracket saddle portion 90 is also preferably provided with a pry slot 106 to aid in cross bar 74 installation. The pry slot 106 is particularly useful, for example, in installations under uneven roof decking, as the pry slot 106 can be used to facilitate insertion of the cross bars 74 into the second T-bracket saddle portion 90.

The combination of a pair of T-bracket assemblies 76 and a cross bar 74 secured therebetween defines a cross member 112 of the support system 10 of the present disclosure. Once the support system 10 is fully assembled between a pair of bar joists 12, 12', the cross members 112 can support loads therebetween, with the support system 10 effectively transmitting forces to the horizontal flanges 24 of the bar joists 12, 12'.

When it is desired to support a pair of cross bars 74 aligned with one another across a structural framing bar 62, a cross support bracket, which shares similarities with the T-bracket assembly 76, may be provided. A cross support bracket is generally shaped like a plus-sign, "+", and may be constructed by taking the T-bracket assembly 76, and modifying it to include a third T-bracket saddle portion, similar to the second T-bracket saddle portion, but extending perpendicularly from a central region of the opposite sidewall 84 of the first T-bracket saddle portion 90.

Turning to FIGS. 19-22, an end bracket 228 of a support system of the present disclosure specifically adapted for use on joist girders positioned under a roof deck is illustrated. Joist girders are typically spaced 2½" (6.35 cm) from the bottom of roof deck flutes. The end bracket 228, which is a girder bracket adapted for securement to such joist girders, includes a saddle 244 and a channel member 246. The saddle 244 and channel member 246 may be welded or riveted to one another, such as at location R in FIG. 19. Unlike in the end bracket 28 of the first embodiment, the channel member 246 preferably does not run the entire length of the saddle 244. Rather, the channel member 246 terminates at or near a first end of the sidewalls 258, 260 of the saddle 244, as can be appreciated with reference to the cross-sectional view of FIG. 22. The channel member 246 extends over the top flanges 224 of a joist girder 212. Because the channel member 246 does not run the entire length of the saddle 244, the saddle 244 is also able to accommodate a crossbar member 262, preferably of tube steel. The tube steel crossbar 262 can extend to an opposing t-bracket (not shown), that may attach to an elongate bar 62, 62'. In this manner, crossbars 262, preferably comprised of discrete lengths of tube steel, can be secured to a joist girder 212 to form a support system for the roof deck 261 or to hang apparatus from just below the roof deck 261.

The sidewalls 258, 260 of the saddle 244 may be provided with opposing fastener-receiving apertures 266, 268. The opposing fastener-receiving apertures 266, 268 are spaced vertically below a top plate 256 of the saddle member 244 a distance greater than the height of the sidewalls 264 of the crossbar 262. The fastener-receiving apertures 266 on at least one of the sidewalls 258, 260 of the saddle 244 are preferably square to accommodate a complementary square underside 270 of a head of a carriage bolt 272, thereby preventing rotation of the carriage bolt 72 relative to the saddle 44.

Figure 23:
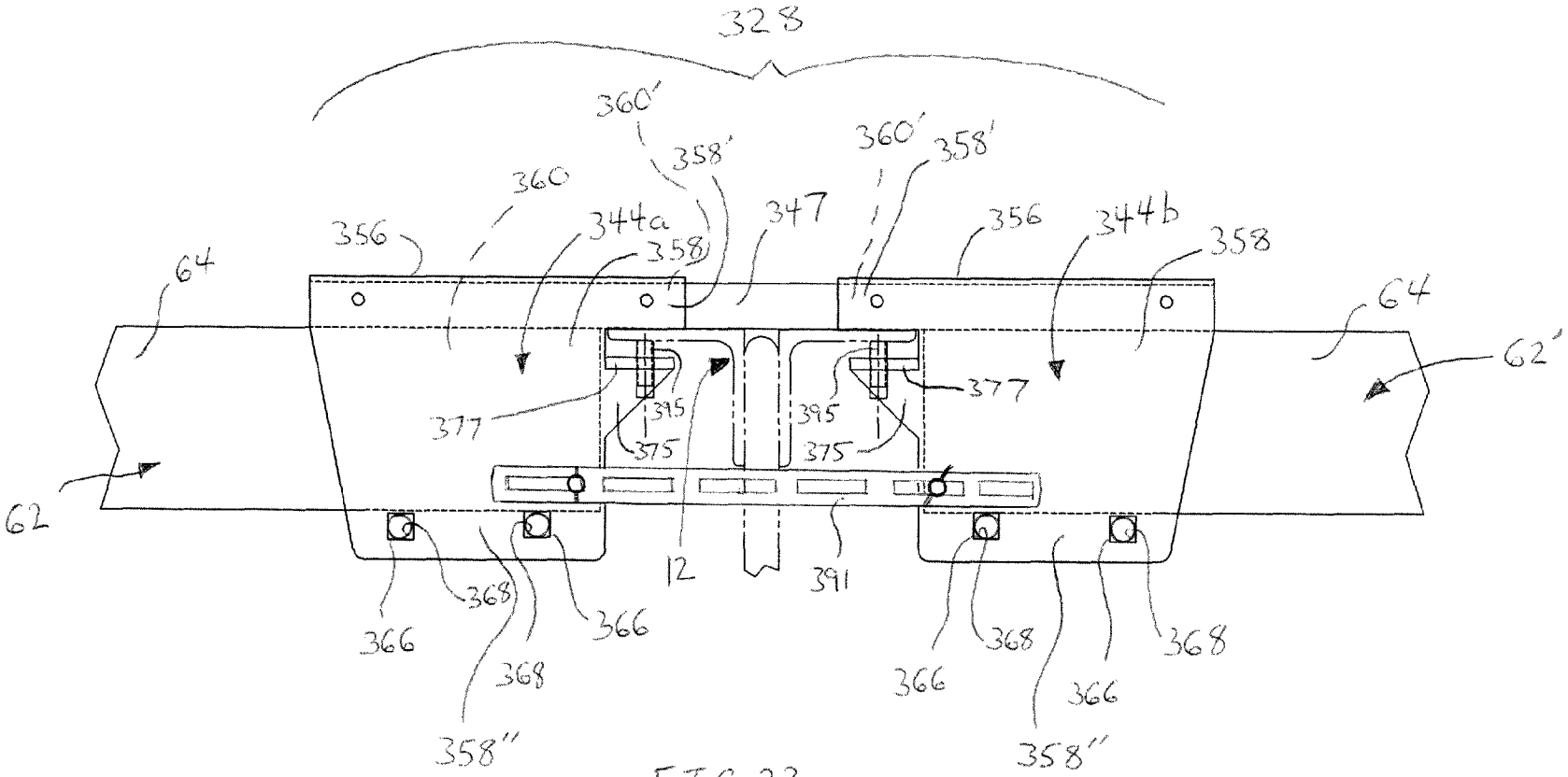
FIG. 23 is a plan view of a pass through bracket of the present disclosure for securing a pair of structural framing bars to a bar joist.
Figure 24:
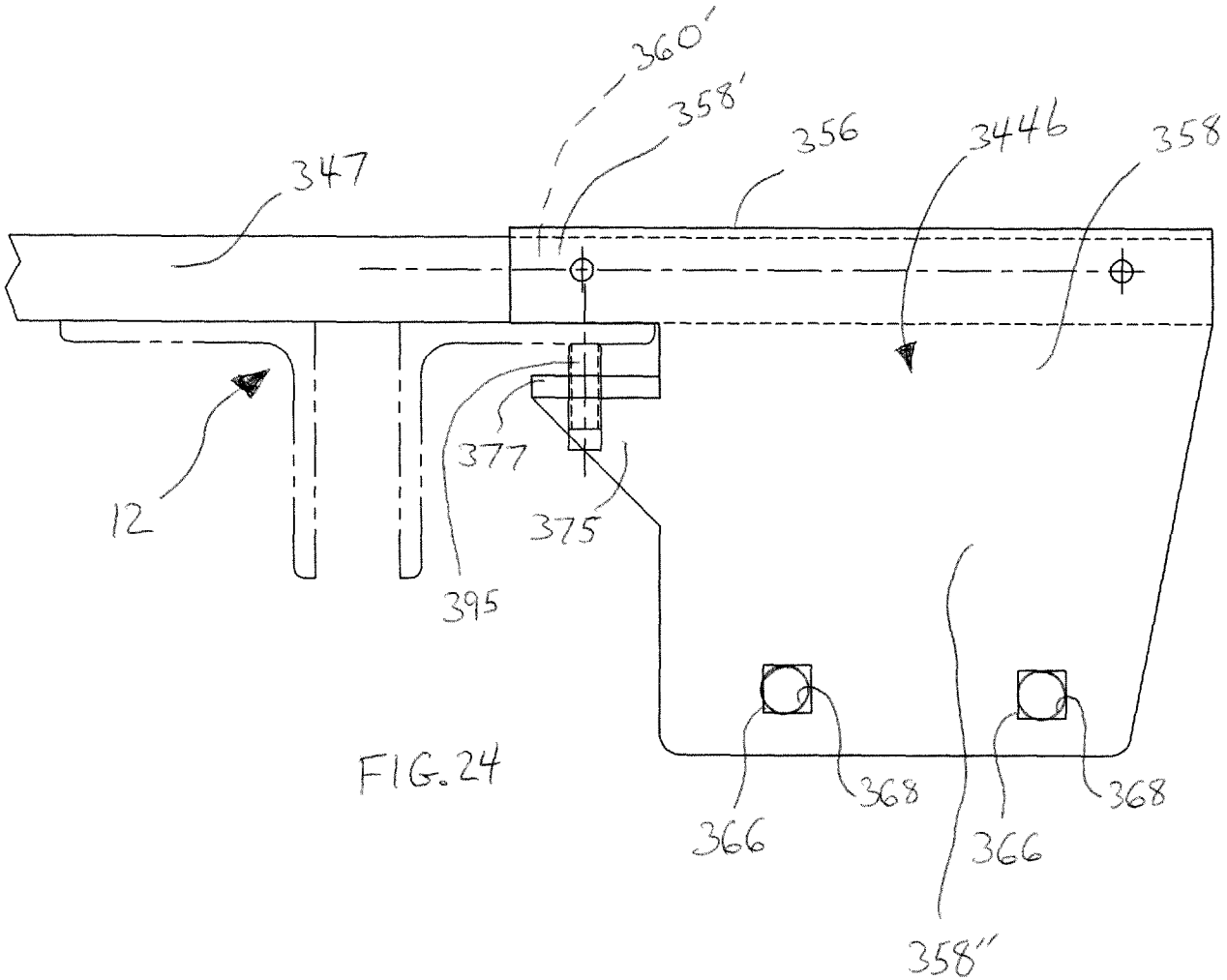
FIG. 24 is a plan view of a bracket that may be used as part of the pass through bracket illustrated in FIG. 23.

Turning to FIGS. 23 and 24, yet another bracket assembly of the present disclosure is illustrated, in the form of a pass through end clamp or bracket 328 for attachment of rectangular tubes or structural framing bars 62, 62' on both sides of a bar joist. While this particular bracket 328 shares some similarities with the aforementioned end bracket 28, the pass through bracket 328 does not require use of a separate heel clip. Rather, the pass through bracket 328 includes a first portion that slides over a bar joist 12, and a second portion that secures the pass through bracket 328 across the bar joist 12. A plurality of fasteners, preferably in the form of self-locking bolts, may be employed under the second portion of the pass through bracket 328, which is disposed below the horizontal flanges of the bar joist 12, to secure the pass through bracket 328 to the bar joist 12. The self-locking bolts prevent lateral movement of the pass through bracket 328 relative to the bar joist 12.

The pass through bracket 328 includes a rectangular tube member 347 that spans two aligned saddle members 344*a*, 344*b*. The rectangular tube member 347 includes a bottom wall, a pair of sidewalls extending upwardly from the bottom wall, and a top wall. The saddle members 344*a*, 344*b* each include a top wall 356, and sidewalls 358, 360. Each of the sidewalls 358, 360 of the saddle members includes a first portion 358', 360' having a vertical height coextensive with a vertical height of the sidewalls of the rectangular tube member 347, the rectangular tube member being secured to the interior of the saddle along the first portion of the sidewall of the saddle. Each of the sidewalls 358, 360 further includes a second portion 358", 360" extending vertically below the bottom wall of the rectangular tube member 347.

The second portions 358", 360" of the sidewalls 358, 360 include projections 375 extending in a direction parallel to the first portions 358', 360'. The projections 375 may be triangular or generally triangular in shape, and are spaced from the bottom of the first portions 358', 360' of the sidewalls 358, 360. The projections 375 cooperate to support a plate 377 secured to the upper horizontal surface of the projections 375, defining a lower jaw 379, spaced from the first portions 358', 360' and bottom wall of the rectangular tube member 347 by a distance that accommodates the top surface or flange of a bar joist 12. The lower jaws of the respective saddle members are open in a direction toward one another. The plate 377 includes a hole therein to receive a fastener, preferably in the form of self-locking bolt 395, used to secure the respective saddle member 344*a*, 344*b* to the bar joist 12.

Opposing fastener-receiving apertures 366, 368 are provided in the sidewalls 358, 360 of the saddle members 344*a*, 344*b*. The opposing fastener-receiving apertures 366, 368 are spaced vertically below the bottom wall of the rectangular tube member 347 a distance greater than the height of the sidewalls 64 of an elongate structural framing bar 62, 62', so that each of the saddle members 344*a*, 344*b* accommodates a respective elongate structural framing bar 62, 62'. The fastener-receiving apertures 366 on at least one of the sidewalls 358, 360 of the saddle members 344*a*, 344*b* are preferably square to accommodate a complementary square underside of a head of a carriage bolt, thereby preventing rotation of the carriage bolt relative to the pass through bracket 328. A perforated band 391 may be secured by fasteners, such as nuts and bolts, through additional apertures in the sidewalls 358, 360 of the saddle members 344*a*, 344*b*, beneath the bar joist 12, to provide additional securement of the pass through bracket 328 to the bar joist 12.

It will be appreciated that the end brackets, T-brackets, cross support brackets, girder brackets, and pass through brackets of the present disclosure are modular, in that they may be employed in a wide variety of different combinations to provide customized framing support solutions.

While the support system has been described with respect to certain embodiments thereof, it will be understood that variations may be made thereto that are still within the scope of the present disclosure and the appended claims.

I claim:

1. A system for securing support framing members between a pair of bar joists or beams, comprising: a first pair of end brackets securable to a first bar joist or beam, including a first end bracket; and a second end bracket spaced from the first end bracket a distance corresponding to at least a length of a support framing cross bar; a second pair of end brackets securable to a second bar joist or beam spaced horizontally from the first bar joist or beam, including a third end bracket disposed in alignment with, and in an orientation opposite from, the first end bracket; and a fourth end bracket disposed in alignment with, and in an opposite orientation from, the second end bracket; a first support framing bar securable between the first and third end brackets; a second support framing bar securable between the second and fourth end brackets; a first pair of T-shaped bracket assemblies securable to the first support framing bar; a second pair of T-shaped bracket assemblies securable to the second support framing bar, each of the T-shaped bracket assemblies of the second pair of T-shaped bracket assemblies disposed in alignment with, and in an opposite orientation from, a respective T-shaped bracket assembly of the first pair of T-shaped bracket assemblies, wherein each T-shaped bracket assembly of the first and second pairs of T-shaped bracket assemblies includes: a first T-bracket saddle portion forming an upper cross-portion of the T-shape, the first T-bracket saddle portion including a top plate and first and second sidewalls depending downward from the top plate and spaced apart from one another a distance sufficient to accommodate a width of one of the support framing bars; and a second T-bracket saddle portion forming a trunk portion of the T-shape and extending perpendicularly from a central region of one of the first and second sidewalls of the first T-bracket saddle portion, the second T-bracket saddle portion including a top wall and a pair of sidewalls depending downwardly from the top wall of the second T-bracket saddle portion, the sidewalls of the second T-bracket saddle portion spaced apart from one another a distance sufficient to accommodate a width of a support framing cross bar, wherein each T-shaped bracket assembly of the first and second pairs of T-shaped bracket assemblies further includes a pair of apertures through the first sidewall of the first T-bracket saddle portion and a pair of apertures through the second sidewall of the first T-bracket saddle portion aligned with a respective one of the apertures through the first sidewall of the first T-bracket saddle portion, each of the apertures being spaced below the top plate of the first T-bracket saddle portion a distance sufficient to accommodate a height of one of the support framing bars, the second T-bracket saddle portion of each T-shaped bracket assembly of the first and second pairs of T-shaped bracket assemblies further including a winged extension projecting perpendicularly from each of the first and second sidewalls of the second T-bracket saddle portion and adjacent one of the first and second sidewalls of the first T-bracket saddle portion, each of the winged extensions having an aperture therethrough aligned with a respective one of the apertures through the sidewall to which the winged extension is adjacent.

2. The system of claim 1, wherein the apertures of at least one of the pairs of apertures through the first sidewall of the T-bracket saddle portion or the second sidewall of the T-bracket saddle portion are square.

3. A system for securing support framing members between a pair of bar joists or beams, comprising: a first pair of end brackets securable to a first bar joist or beam, including a first end bracket; and a second end bracket spaced from the first end bracket a distance corresponding to at least a length of a support framing cross bar; a second pair of end brackets securable to a second bar joist or beam spaced horizontally from the first bar joist or beam, including a third end bracket disposed in alignment with, and in an orientation opposite from, the first end bracket; and a fourth end bracket disposed in alignment with, and in an opposite orientation from, the second end bracket; a first support framing bar securable between the first and third end brackets; a second support framing bar securable between the second and fourth end brackets; a first pair of T-shaped bracket assemblies securable to the first support framing bar; a second pair of T-shaped bracket assemblies securable to the second support framing bar, each of the T-shaped bracket assemblies of the second pair of T-shaped bracket assemblies disposed in alignment with, and in an opposite orientation from, a respective T-shaped bracket assembly of the first pair of T-shaped bracket assemblies, wherein each T-shaped bracket assembly of the first and second pairs of T-shaped bracket assemblies includes: a first T-bracket saddle portion forming an upper cross-portion of the T-shape, the first T-bracket saddle portion including a top plate and first and second sidewalls depending downward from the top plate and spaced apart from one another a distance sufficient to accommodate a width of one of the support framing bars;

and a second T-bracket saddle portion forming a trunk portion of the T-shape and extending perpendicularly from a central region of one of the first and second sidewalls of the first T-bracket saddle portion, the second T-bracket saddle portion including a top wall and a pair of sidewalls depending downwardly from the top wall of the second T-bracket saddle portion, the sidewalls of the second T-bracket saddle portion spaced apart from one another a distance sufficient to accommodate a width of a support framing cross bar, wherein each T-shaped bracket assembly of the first and second pairs of T-shaped bracket assemblies further includes a pair of apertures through the first sidewall of the first T-bracket saddle portion and a pair of apertures through the second sidewall of the first T-bracket saddle portion aligned with a respective one of the apertures through the first sidewall of the first T-bracket saddle portion, each of the apertures being spaced below the top plate of the first T-bracket saddle portion a distance sufficient to accommodate a height of one of the support framing bars, the top wall of the second T-bracket saddle portion of each of the T-shaped bracket assemblies including a cut out section, facilitating mounting of the T-shaped bracket assembly under a rib or flute of a corrugated roof deck.

4. A system for securing support framing members between a pair of bar joists or beams and to at least one joist girder supporting the pair of bar joists or beams, the system comprising: an end bracket securable to a bar joist or beam, including a saddle having a top plate; and a pair of sidewalls spaced from one another a distance sufficient to accommodate a width of a support framing bar and extending downwardly from the top plate; and one of a channel member or a rectangular tube secured to an interior of the saddle defined by the top plate and the pair of sidewalls of the saddle, the channel member or rectangular tube having a bottom wall; and a pair of upwardly-extending sidewalls; a T-shaped bracket assembly securable to a support framing bar extending from the end bracket, including a first T-bracket saddle portion forming an upper cross-portion of the T-shape, the first T-bracket saddle portion including a top plate and first and second sidewalls depending downward from the top plate and spaced apart from one another a distance sufficient to accommodate a width of a support framing bar extending from the end bracket; and a second T-bracket saddle portion forming a trunk portion of the T-shape and extending perpendicularly from a central region of one of the first and second sidewalls of the first T-bracket saddle portion, the second T-bracket saddle portion including a top wall and a pair of sidewalls depending downwardly from the top wall of the second T-bracket saddle portion, the sidewalls of the second T-bracket saddle portion spaced apart from one another a distance sufficient to accommodate a width of a support framing cross bar; a girder bracket securable to a joist girder spaced from a bottom of a roof deck, including a saddle having a top plate; and a pair of sidewalls spaced from one another a distance sufficient to accommodate a width of a support framing cross bar secured to a support framing bar by the T-shaped bracket assembly and extending downwardly from the top plate; and a channel member secured to an interior of the saddle defined by the top plate and the pair of sidewalls of the saddle, the channel member having a bottom wall; and a pair of upwardly-extending sidewalls; each of the sidewalls of the saddle including a first portion having a vertical height coextensive with a vertical height of the upwardly-extending sidewalls of the channel member, the channel member being secured to the interior of the saddle along the first portion of the sidewall of the saddle; and a second portion extending laterally and vertically beyond a first end of the channel member.

5. The system of claim 4, wherein in the end bracket, each of the sidewalls of the saddle includes a pair of apertures therethrough, each of the apertures aligned with a corresponding one of the apertures in the other sidewall of the saddle, and the apertures in the sidewalls being spaced a distance below the top wall of the saddle sufficient to accommodate a height of a support framing bar between the top wall of the saddle and a pair of fasteners received in the apertures through the sidewalls of the saddle.

6. The system of claim 5, wherein the apertures of at least one of the pairs of apertures through the sidewalls of the saddle are square.

7. The system of claim 4, wherein the T-shaped bracket assembly further includes a pair of apertures through the first sidewall of the first T-bracket saddle portion and a pair of apertures through the second sidewall of the first T-bracket saddle portion aligned with a respective one of the apertures through the first sidewall of the first T-bracket saddle portion, each of the apertures being spaced below the top plate of the first T-bracket saddle portion a distance sufficient to accommodate a height of a support framing bar extending from the end bracket.

8. The system of claim 4, wherein the T-shaped bracket assembly further includes a pair of apertures through the first sidewall of the second T-bracket saddle portion and a pair of apertures through the second sidewall of the second T-bracket saddle portion aligned with a respective one of the apertures through the first sidewall of the second T-bracket saddle portion, each of the apertures being spaced below the top plate of the second T-bracket saddle portion a distance sufficient to accommodate a height of a support framing cross bar extending from the girder bracket.

9. The system of claim 7, wherein the second T-bracket saddle portion of the T-shaped bracket assembly further includes a winged extension projecting perpendicularly from each of the first and second sidewalls of the second T-bracket saddle portion and adjacent one of the first and second sidewalls of the first T-bracket saddle portion, each of the winged extensions having an aperture therethrough aligned with a respective one of the apertures through the sidewall to which the winged extension is adjacent.

10. The system of claim 7, wherein the apertures of at least one of the pairs of apertures through the first sidewall of the T-bracket saddle portion or the second sidewall of the T-bracket saddle portion are square.

11. The system of claim 4, wherein the top wall of the second T-bracket saddle portion of the T-shaped bracket assembly includes a cut out section, facilitating mounting of the T-shaped bracket assembly under a rib or flute of a corrugated roof deck.

12. The system of claim 4, wherein the bottom wall of the channel member or rectangular tube of the end bracket includes an aperture therein.

13. The system of claim 12, wherein the aperture in the bottom wall of the channel member or rectangular tube of each of the end brackets is an elongate slot.

14. The system of claim 12, further comprising a heel clip spaced below the bottom wall of the end bracket and including an aperture through the heel clip to accept a fastener through the apertures of both the heel clip and the bottom wall of the end bracket to facilitate securement of the end bracket to a bar joist or beam.

15. A T-shaped bracket assembly, comprising:

a first T-bracket saddle portion forming an upper cross-portion of the T-shape, the first T-bracket saddle portion including a top plate and first and second sidewalls depending downward from the top plate and spaced apart from one another a distance sufficient to accommodate a width of a support framing bars; and a second T-bracket saddle portion forming a trunk portion of the T-shape and extending perpendicularly from a central region of one of the first and second sidewalls of the first T-bracket saddle portion, the second T-bracket saddle portion including a top wall and a pair of sidewalls depending downwardly from the top wall of the second T-bracket saddle portion, the sidewalls of the second T-bracket saddle portion spaced apart from one another a distance sufficient to accommodate a width of a support framing cross bar, a pair of apertures through the first sidewall of the second T-bracket saddle portion and a pair of apertures through the second sidewall of the second T-bracket saddle portion aligned with a respective one of the apertures through the first sidewall of the second T-bracket saddle portion, each of the apertures being spaced below the top plate of the second T-bracket saddle portion a distance sufficient to accommodate a height of a support framing cross bar, the second T-bracket saddle portion of each T-shaped bracket assembly of the first and second pairs of T-shaped bracket assemblies further including a winged extension projecting perpendicularly from each of the first and second sidewalls of the second T-bracket saddle portion and adjacent one of the first and second sidewalls of the first T-bracket saddle portion, each of the winged extensions having an aperture therethrough aligned with a respective one of the apertures through the sidewall to which the winged extension is adjacent.

16. The system of claim 15, wherein the apertures of at least one of the pairs of apertures through the first sidewall of the T-bracket saddle portion or the second sidewall of the T-bracket saddle portion are square.

* * * * *

UNITED STATES PATENT AND TRADEMARK OFFICE

CERTIFICATE OF CORRECTION

PATENT NO. : 8,528,292 B2
APPLICATION NO. : 13/143828
DATED : September 10, 2013
INVENTOR(S) : Douglas H. Morey It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 212 days.

Signed and Sealed this
Fifteenth Day of September, 2015

Michelle K. Lee

Michelle K. Lee
*Director of the United States Patent and Trademark Office*